US010758969B2

(12) United States Patent
Balduini

(10) Patent No.: US 10,758,969 B2
(45) Date of Patent: Sep. 1, 2020

(54) PROCESS FOR PRODUCING A CERAMIC CASTING CORE

(71) Applicant: JY'NOVE, Belfort (FR)

(72) Inventor: Jean-Yves Balduini, Belfort (FR)

(73) Assignee: JY'NOVE, Belfort (FR)

( * ) Notice: Subject to any disclaimer, the term of this patent is extended or adjusted under 35 U.S.C. 154(b) by 332 days.

(21) Appl. No.: 15/820,652

(22) Filed: Nov. 22, 2017

(65) Prior Publication Data

US 2018/0147622 A1 May 31, 2018

(30) Foreign Application Priority Data

Nov. 29, 2016 (FR) ..... 16 61623

(51) Int. Cl.

| | |
|---|---|
| ***B22C 9/10*** | (2006.01) |
| ***B22C 9/18*** | (2006.01) |
| ***B22C 9/04*** | (2006.01) |
| ***B22C 9/12*** | (2006.01) |

(52) U.S. Cl.

CPC ..... *B22C 9/10* (2013.01); *B22C 9/04* (2013.01); *B22C 9/12* (2013.01); *B22C 9/18* (2013.01)

(58) Field of Classification Search

CPC .... B22C 9/10; B22C 9/04; B22C 9/12; B22C 9/18

See application file for complete search history.

(56) References Cited

U.S. PATENT DOCUMENTS 3,933,335 A * 1/1976 Maruyama ..... B22C 3/00 249/114.1
5,465,780 A 11/1995 Muntner et al.
5,565,780 A 10/1996 Derby
7,302,990 B2 12/2007 Bunker et al.
7,458,411 B2 12/2008 Prigent et al.
7,533,714 B2 5/2009 Guerche et al.
8,490,673 B2 7/2013 Defrocourt et al.

(Continued)

FOREIGN PATENT DOCUMENTS

DE 10 2005 021 664 A1 12/2005
DE 10 2008 037 534 A1 5/2010

(Continued)

OTHER PUBLICATIONS

French Search Report Corresponding to 1661623 dated Sep. 13, 2017.

(Continued)

*Primary Examiner* — Kelly M Gambetta

(74) *Attorney, Agent, or Firm* — Davis & Bujold PLLC; Michael J. Bujold

(57) ABSTRACT

A production method for a ceramic casting core (20) in which one manufactures the core (20) by machining by mechanical removal of material from a fired ceramic material block (1), the machining operation comprising at least a first machining step to realize a first machined surface (6, 7) in the material block (1), and a second machining step to realize a second machined surface (9) in the material block (1), substantially opposite to the first machined surface (6). Prior to the second machining step, applying a reinforcement layer (8), made of a stiffening solution to protect the material block (1) from breaking during the second machining step, on at least part or the entire first machined surface (6, 7).

15 Claims, 2 Drawing Sheets

(56) References Cited

U.S. PATENT DOCUMENTS

| | | | | |
|---|---|---|---|---|
| 2007/0261811 | A1* | 11/2007 | Guerche | B22C 9/103 164/28 |
| 2016/0256918 | A1 | 9/2016 | Schilling | |

FOREIGN PATENT DOCUMENTS

| | | | |
|---|---|---|---|
| FR | 2 878 458 | A1 | 6/2006 |
| FR | 2 900 850 | A1 | 11/2007 |
| FR | 2 930 188 | A1 | 10/2009 |
| FR | 2 989 917 | A1 | 11/2013 |
| WO | 97/02914 | A1 | 1/1997 |
| WO | 01/89738 | A1 | 11/2001 |
| WO | 2015/051916 | A1 | 4/2015 |

OTHER PUBLICATIONS

French Written Opinion Corresponding to 1661623 dated Sep. 13, 2017.

* cited by examiner

PROCESS FOR PRODUCING A CERAMIC CASTING CORE

TECHNICAL SCOPE

The present invention relates to a process for producing a ceramic casting core for the manufacture of a hollow part with a complex cavity by lost-wax casting, such as a rotor or stator for a gas turbine, an aircraft engine, a reactor, a combustion chamber or the like, said core being an image of the complex cavity of the hollow part to be produced.

PRIOR ART

The production technique of metal parts by lost-wax investment casting is widely spread and used especially for producing hollow metallic precision parts that can have very complex internal or external shapes, such as for example rotors and stators for gas turbines, aircraft engines, reactors, combustion chambers, etc., these parts being used in various sectors such as energy, aeronautics, airspace, etc. These parts are very technical and their internal and external shapes are dictated by aeraulic constraints. They are hollowed for weight purposes, but especially to house a network of internal channels that allow the circulation of a cooling fluid. These examples are of course not limiting.

This lost-wax casting production technique is very complex to implement and requires a plurality of intermediate manufacturing steps, each complex and tedious to carry out, making this production method particularly long and expensive. So, every new part to be produced, or any modification or evolution to be made on an existing part, requires a very long time, which is prejudicial in the research and development phase, to generate new parts and optimize the aerodynamic, aeraulic, etc. characteristics of said parts.

One of the steps of this lost-wax casting production method consists in manufacturing a ceramic core with a complex geometry and sides or walls that can be very thin, of the order of one millimeter, as this core must be hollowed and include openings to define the exact internal volume of the hollow part to be produced. The ceramic core is preferably made out of a technical ceramic material or any other compatible material, that is to say a material that has high mechanical strength, high hardness and that withstands very high temperatures given the melting temperature of metals and metal alloys, which is of the order of 1500° C. Moreover, this technical ceramic or the like must be able to be dissolved chemically to set free the complex internal cavity of the hollow part obtained after casting. This ceramic core is intended for being embedded in a wax blank obtained by molding and whose external geometry defines the external volume of the hollow part to be produced. The wax blank is dipped in a ceramic bath to coat it with a hard ceramic shell. The ceramic shell is heated up to the melting temperature of the wax, allowing removing the wax that drains off the shell, leaving inside of the shell a negative volume defined between the inner wall of the shell and the outer wall of the internal core. The molten metal is then cast inside of the ceramic shell. After cooling down, the external ceramic shell and the internal core are removed by shakeout to release the hollow part obtained. The casting technique allows obtaining quality finished parts requiring no subsequent finishing operation.

Classically, the ceramic casting cores are produced by molding in a multislide mold. Manufacturing the mold is very tedious as the cavities, which are the negative images of the core to be produced, are very complex and make the design of the mold and its manufacture very expensive and very long. Only for example, the average manufacture time of such a mold is approximately one year and represents an investment of about one million Euros.

Various production processes have been developed to overcome in part these drawbacks and try to reduce the manufacturing time and cost of the molds and, consequently, the production cost of the ceramic casting cores.

One of the techniques consists in providing a contact machining step of a previously cast ceramic core blank, with or without internal hollowing. This machining step allows either machining the hollowing as such, or perfect the internal hollowing already partly finished by molding, or deburring the blank obtained. Depending on whether the machining step is performed on a raw and flexible ceramic, that is to say before firing, or on a fired and hard ceramic, it can be carried out either by material removal such as milling or abrasion, as the examples described in publications FR 2 878 458 A1, FR 2 930 188 A1 and FR 2 900 850 A1. Another technique consists in providing a non-contact machining step of a previously cast ceramic core blank, this machining step being carried out on a fired ceramic by laser or by ultrasound to perfect the dimensional characteristics of said core, as the examples described in publications U.S. Pat. No. 5,465,780 A and WO 97/02914 A1.

These contact or non-contact machining techniques however do not allow doing without the previous molding step of a ceramic core blank, imposing the constraints mentioned above. Therefore, the necessary time and the investment for the molds are not substantially reduced.

With the advent of additive manufacturing, new techniques have emerged, allowing producing ceramic cores on 3D printing machines from digitized 3D core models, such as the examples described in publications DE102008037534 A1 and DE 102005021664 A1. However, the materials compatible with this new technique pose removal problems after casting, as they are difficult to dissolve. In fact, they do not correspond to the ceramics currently qualified for lost-wax casting of hollow series parts, as their composition has been obtained empirically in the traditional processes and could not be reproduced yet in 3D printing. Moreover, the production cost of a ceramic core in 3D printing is about twenty times higher than that of a core obtained by molding. This cost is totally prohibitive and in no relation with the price the market is ready to accept. In fact, there is today no ceramic core obtained by 3D printing that would be qualified for a "series" part, which proves the unsuitability of this solution.

Publication WO 2015/051916 A1 proposes to use a numerically controlled machine to machine the ceramic core as well as the external lost-wax blank arranged around said core, however without specifying the operating mode, considering the machining difficulties of said core.

DESCRIPTION OF THE INVENTION

The present invention offers a new production process that allows solving the problems mentioned above, shortening substantially the production process of ceramic cores for lost-wax casting, and reducing correlatively the investment cost, in order to reduce the cycle and the development cost if new parts of gas turbines, aircraft motors, reactors, combustion chambers and of any hollow part with a complex cavity, to give flexibility to the management of industrial processes, to authorize an evolution of the geometry of already existing parts. Only for example, the duration of the tryout of the production process according to the invention can be divided by a coefficient 10 and its cost by a coefficient 40 in comparison with the classical molding method. This new production method moreover allows manufacturing pre-series and parts on demand.

To this purpose, the invention relates to a production method of the kind described in the preamble, characterized in that one manufactures said core by machining by mechanical material removal a fired ceramic material block, in that the machining operation comprises at least a first machining step to realize a first machined surface in said material block, and a second machining step to realize a second machined surface in said material block, substantially opposite to said first machined surface, and in that, prior to said second machining step, one applies on the whole or on a part of said first machined surface a reinforcement layer made of a stiffening solution to protect said material block from breaking during the second machining step and one waits for the solidification of said reinforcement layer before carrying out the second machining step.

Thus, this production process by machining goes against a prejudice that consists in saying that machining a ceramic core by mechanical material removal is difficult or even impossible. For example, publications U.S. Pat. No. 5,565,780 A and WO 2001/89738 A1 clearly indicate the impossibility of such machining, by traditional techniques that use a machining tool in contact with the core, as well as the limit size of machining beyond which using a cutting tool is impossible. In fact, as this core must be significantly hollowed and provided with openings, whereby the empty spaces can represent more than 30% of said core, and its remaining sides or walls are often very thin, in the order of one millimeter, the core is particularly fragile and brittle. So, the mechanical contact machining cannot be obtained without deteriorating or partly or totally breaking the ceramic core due to the vibrations generated by the cutting tool inside of the core, which lead to the breakage of the weakened zones.

If the machining operation comprises several machining steps, one repeats the application of a reinforcement, layer before every new machining step on the whole or a part of a surface of said material block substantially opposite to said new surface to be machined.

Prior to the application of said reinforcement layer, one can clean and degrease said material block to further the adhesion of said stiffening solution.

One can advantageously use as a stiffening solution a liquid or semi-liquid machining glue having machinable and dissolvable properties. And one can apply said reinforcement layer in one or several stiffening solution applications.

Depending on the surface to be reinforced on said material block, one can apply said stiffening solution with a brush, or by gravity, pouring said solution on said material block.

To machine said core in said material block, one advantageously uses a numerically controlled multi-axis machining center and diamond cutting tools.

To machine said core in said material block, one preferably uses a material block comprising at least two parallel opposite sides arranged to form two clamping faces on which the jaws of a clamping vise of a machining equipment are applied.

Prior to the machining operation of said core, one advantageously machines in said material block at least one reference surface that will allow removing and putting back in place said material block on a machining equipment respecting a parallelism deviation lower than 0.05 mm.

Preferably, after the machining operation of said core, one removes the reinforcement layer(s). For this removal, one can dip said core in a solvent bath or subject said core to a temperature corresponding to the melting temperature of the stiffening solution.

In this case, one suspends said core on a bracket to allow draining the molten stiffening solution by gravity flow.

BRIEF DESCRIPTION OF THE DRAWINGS

The present invention and its advantages will be better revealed in the following description of an embodiment given as a non limiting example, in reference to the drawings in appendix, in which FIGS. 1 to 4 represent schematically front views of several steps of a production process of a ceramic core according to the invention, in which FIG. 1 illustrates the mounting of a ceramic block between two clamping jaws of a machining equipment to machine a first side of a blank of said core, FIG. 2 illustrates the application of a stiffening solution on the first machined side of the blank, FIG. 3 illustrates the machining of a second side of the blank of said core, located opposite to the first machined and stiffened side, and FIG. 4 illustrates the removal of the stiffening solution after machining the second side of the blank.

ILLUSTRATIONS OF THE INVENTION AND BEST WAY OF REALIZING IT

The method for producing a ceramic core 10 out of a ceramic material of the like according to the invention takes place by mechanical machining of said core directly in the mass of a machinable technical ceramic block intended for investment casting, machining being performed by material removal using one or several cutting tools on a traditional machining equipment. This machining equipment can be for example a numerically controlled multi-axis machining center that allows realizing a plurality of simple up to very complex shapes. Of course, any mechanical machining equipment can be suitable. In the embodiment example described below, one used a five-axis milling center which allows machining complex shapes, which are very current in ceramic cores. There are of course machining centers specifically equipped for machining ceramics and which allow increasing productivity, but their cost cannot always be amortized.

Figure 1:
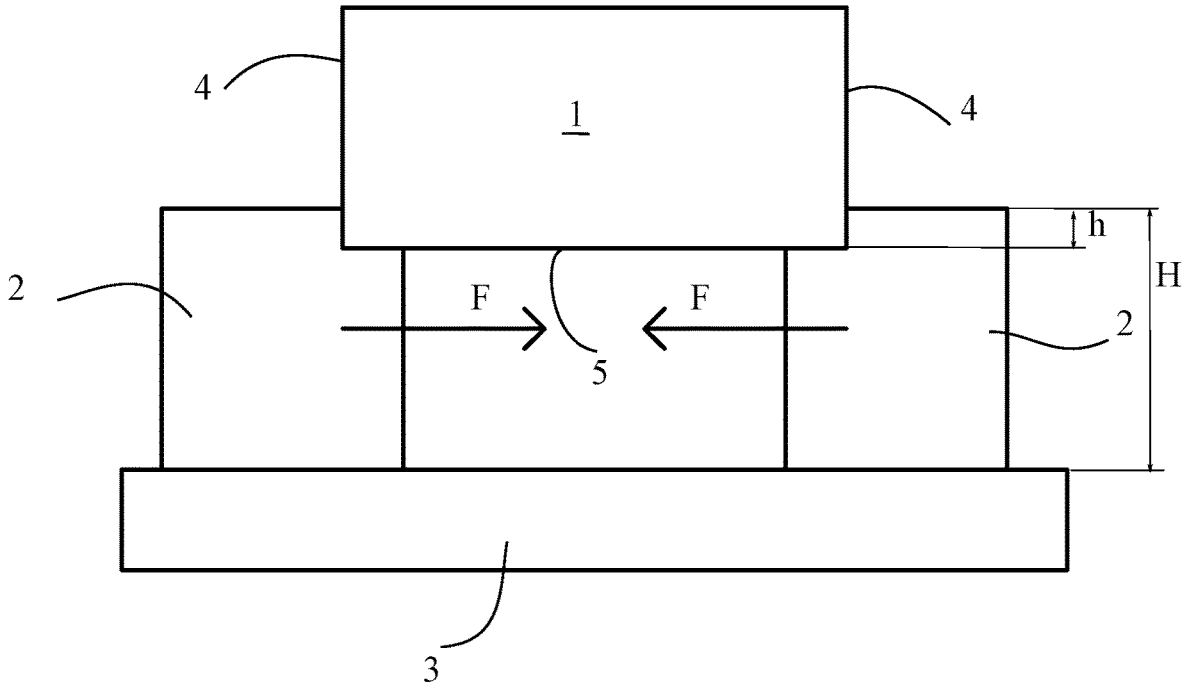

More specifically and referring to FIG. 1, the production process comprises a mounting step of a ceramic block 1 between two jaws 2 of a clamping vise 3 of a machining equipment (not represented) in the direction of arrows F. Ceramic block 1 is a machinable technical ceramic blank, that is to say a fired ceramic block having for example a hardness equivalent or comparable to that of fiberglass reinforced composite material. This ceramic block 1 can have a parallelepipedic shape as illustrated, or any other shape according to the general shape of core 20 to be machined, such as for example a polyhedron, a cylinder. The positioning and indexing of ceramic block 1 on the machining equipment are important to ensure the accuracy of the various machining steps, whatever the number of times said block is removed and put back in place. So, if ceramic block 1 is parallelepipedic, it must have two opposite and parallel clamping sides 4 with a parallelism deviation of for example no more than 0.1 mm. Clamping height h of the two jaws 2 on clamping sides 4 of ceramic block 1 must be minimal, but sufficient to ensure the immobilization of ceramic block 1 and for example equal to at least mm for a block height lower or equal to 30 mm and, beyond this height, equal to at least 10% of the height of said block. Height H of the two jaws 2 must be important and at least equal to 70 mm to facilitate the access of the machining tools to the different sides of ceramic block 1, and in particular to its lower side. The clamping of ceramic block 1 must be controlled to apply a low but sufficient clamping three, for example between 1 kN and 5 kN. One will use to that purpose a torque wrench to tighten the two jaws 2 according to arrows F. The values stated above are given as examples and have no limiting effect. Likewise, the way of mounting ceramic block 1 on a machining equipment can vary according to the shape of said block. For example, if it is cylindrical, one will use a cylindrical clamping chuck and the peripheral base of said block can be used as a reference surface.

One starts machining ceramic block 1 by making a reference surface 5 that will allow removing and putting back in place ceramic block 1 with an accuracy of at the most 0.05 mm. In the illustrated example, one can choose at least the lower side and one of clamping sides 4 of ceramic block 1 as reference surface 5, which has the advantage of remaining accessible and available up to the last step of the machining process. One can then carry out a first machining step on a first part of ceramic block 1 to make a first machined surface 6 (see FIG. 2).

Figure 2:
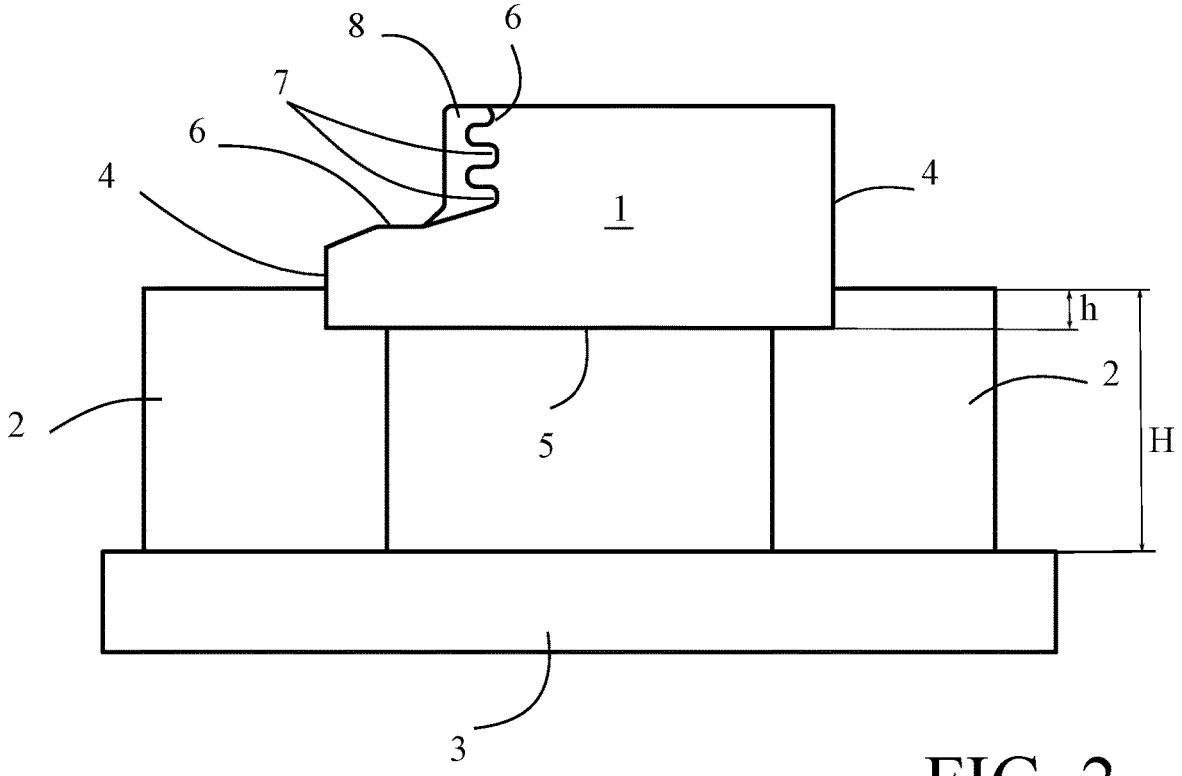

Referring to FIG. 2, this first machined surface 6 has been made on the left side (on the figure) of ceramic block 1 by removing the corresponding angle of the block and in particular by creating cavities 7. After this first machining step and before carrying out the next machining step, one will stiffen machined surface 6 by applying a stiffening solution to form a reinforcement layer 8 and one will wait for the solidification of this reinforcement layer 8 before starting the second machining step. Prior to this application, ceramic block 1 must preferably be cleaned and degreased to free it from dust and machining oil and thus allow the adhesion of the stiffening solution on the surface of ceramic block 1. For this cleaning phase, one can use an automatic washing device adapted to avoid any damage to the ceramic. One then applies the stiffening solution at least on first machined surface 6, taking care to fill recesses 7. This stiffening solution, which is preferably a machining glue, can be applied by any suitable means in one or several applications. The thickness of reinforcement layer 8 obtained must be at least equal to 2 mm to achieve the expected stiffening effect. One can apply the stiffening solution when it is in liquid state by means of a brush or by gravity, pouring it from a determined, not too great height, in the order of some centimeters, from a container containing a sufficient quantity of solution. This technique for applying a stiffening solution in liquid state is the most suitable for filling recesses 7 with a depth exceeding 2 mm. Of course, any other application method may be suitable according to the geometry of machined surface 6 to be stiffened and according to the fluidity of the stiffening solution, it must be possible to clean the stiffening solution to allow removing it from ceramic block 1 after machining, if it does not have this property, its residues shall not make the use or the functions of the obtained ceramic core impossible. It must also keep its stiffening properties up to a temperature at least equal to 50° C., which corresponds to the temperature raise undergone by ceramic block 1 during machining, even with coolant.

Suitable stiffening solutions are for example existing machining glues such as the adhesive pastes marketed under the names Araldite 2011 and Araldite 2012, the machining glue marketed under the name Rigidax by the Paramelt company, or any other stiffening solution in paste or semi-fluid form, adhesive or not, having the following specific characteristics: it must be machinable and dissolvable without causing the dissolution of the ceramic it is applied on. The existing solvents that allow dissolving these machining glues, adhesive pastes or any other stiffening solution can be for example a universal stripper marketed under the name Syntilor Chrono 10, a gelled aerosol stripper marketed under the reference 1310, a foaming stripper marketed under the name Sansil, etc. These examples are of course not limiting.

Figure 3:
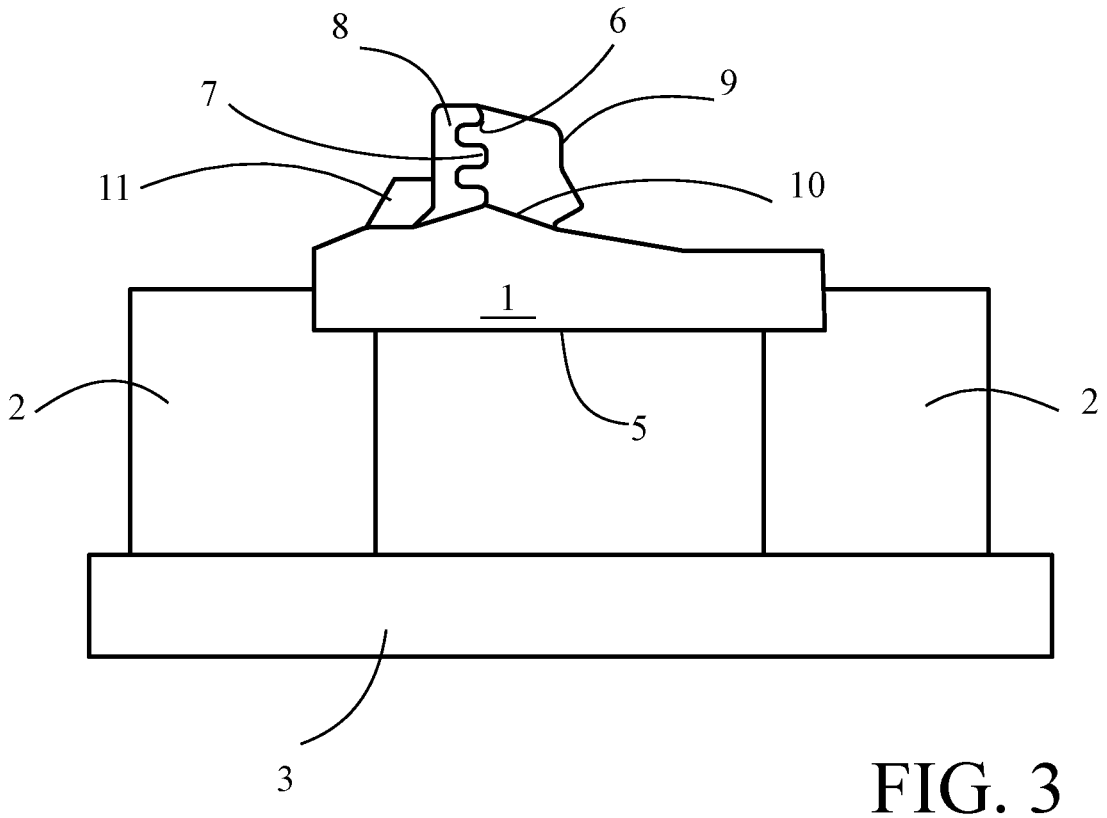

FIG. 3 illustrates ceramic block 1 remaining after the second machining step of the process, which has been carried out on the right side (on the figure) of the block and during which the corresponding angle of the block has been removed to create a second machining surface 9. This second machining surface 9 is substantially located opposite to or on the back of first machining surface 6. The terms "opposite" and "back" must not be construed in a restrictive sense. For example, the second machined surface can be the reverse side of the first machined surface forming the front of the core, or the inner side of the first machined surface forming the outer side of the core. So, during machining, the forces and vibrations induced in ceramic block 1 by the machining tool(s) (not represented) are directed towards first machined surface 6 and liable to lead to breakages in ceramic block 1. However, they will have no detrimental effect on first machined surface 6 or on cavities 7 as they have been protected and filled by reinforcement layer 8.

At the end of this second machining step and before carrying out the next machining step, which consists in machining a third surface 10 to separate core 20 from the remaining ceramic block 1, one applies once more a stiffening solution to form a second reinforcement layer 11 on the back of third surface 10 to be machined. As explained previously, the remaining ceramic block 1 must be cleaned and degreased to free it from dust and machining oil and thus allow the adhesion of the stiffening solution on the surface of ceramic block 1. One then applies the stiffening solution in the angle formed between first machined surface 6 and the remaining part of ceramic block 1, opposite to third surface 10 to be machined. This second strengthening layer 11 thus allows holding core 20 obtained after relieving during a third machining step, namely after the separation of the obtained core 20 from the remaining part of ceramic block 1 commonly called a heel.

Figure 4:
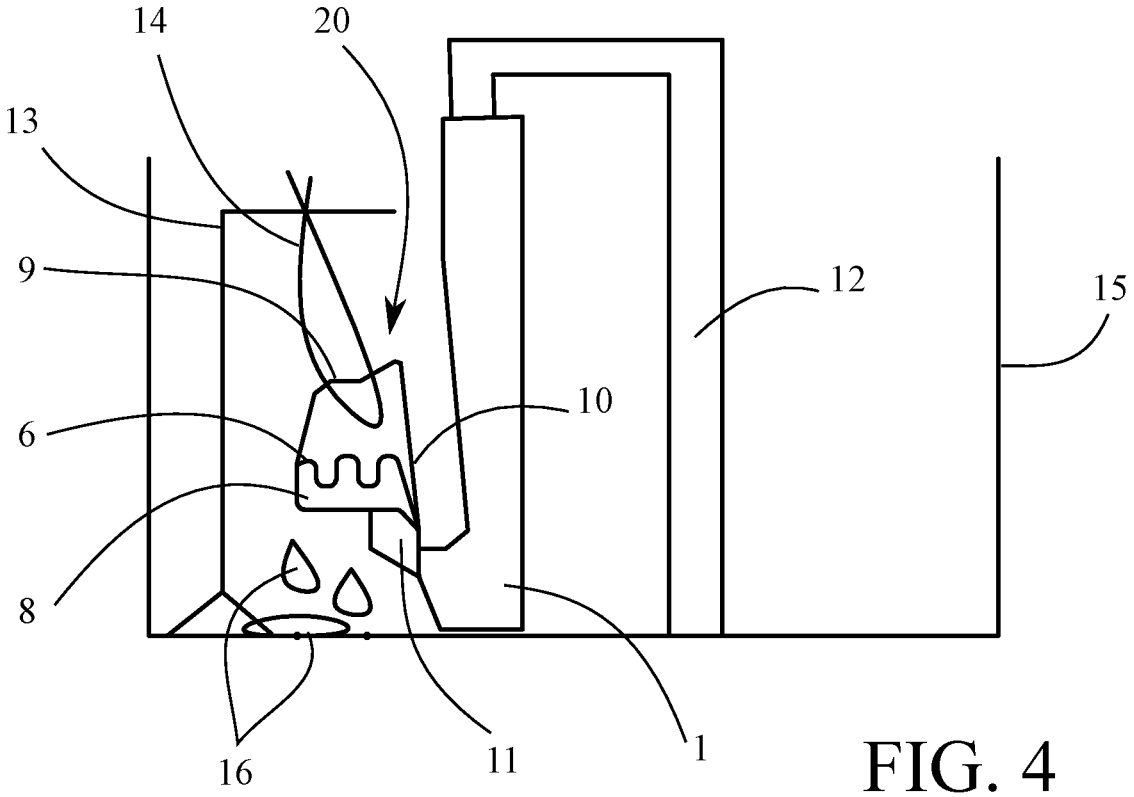

FIG. 4 illustrates the last step of the production process according to the invention, which corresponds to the cleaning of core 20 obtained after the third machining step, which allows machining third surface 10 separating core 20 from ceramic block 1. In this example, the heel of ceramic block 1 is turned by a quarter turn and held vertically by a retainer clamp 12. A bracket 13 is located in front of retainer clamp 12, arranged to support core 20 by any suitable suspension means such as a tie 14 that can pass through the openings of core 20 to retain it after the stiffening solution has molten. The whole set is placed in a collecting vat 15 that resists at least to a temperature in the order of 200° C. The whole is placed in an oven, a stove or the like for at least 3 h at at least 120° C. to make stiffening solution 16 melt and flow by gravity from core 20 and from remaining ceramic block 1 into the bottom of collecting vat 15. One will position core 20 in such a way that the stiffening solution flows without contaminating the areas of core 20 that were not covered with it. Likewise, one will arrange tie 14 through core 20 so as not to damage it. The stiffening solution recovered in collecting vat 15 can be recycled one or several times, depending on its level of impurities. Of course, any other fixture and/or technical means allowing removing stiffening solution 16 from machined ceramic core 20 can be suitable. One can for example dip core 20 in a solvent bath.

The above description of the production process according to the invention referring to the attached drawings is based on an implementation and realization example of a very simplified core, schematized to the extreme. The essential point of the invention lies in the fact of applying regularly, or even at every step of the machining process, a stiffening solution on the machined and therefore weakened areas of ceramic block 1 in order to avoid ceramic breakage.

Other additional precautions can also be recommended. These include in particular machining the various surfaces of ceramic block 1 from top to bottom, which allows preserving the rigidity of said block, and using natural diamond cutting tools or super-abrasive cutting tools of the PCD or CBN type. On can perform the machining operations dry or with a soluble cutting oil or any other suitable coolant. The use of cutting oil allows reducing cutting tool wear, but it requires cleaning ceramic block 1 prior to every application of the stiffening solution. The cutting conditions must also be adapted to the rigidity of ceramic block 1 and of core 20 to be machined. If it is includes little hollowing, in the order of about 30% empty spaces, it is possible to use high machining conditions, for example exceeding 300 m/min up to the last machining step. If core 20 includes much hollowing, for example more than 30% empty spaces, the machining conditions must be divided at least by 2. It is also possible to complete the machining of ceramic block 1 with an ultrasonic spindle to machine the most fragile sections of core 20, such as for example the machining center Tongtai VU-5.

POSSIBILITIES FOR INDUSTRIAL APPLICATION

This description shows clearly that the invention allows reaching the goals defined, that is to say produce a ceramic core only by mechanical machining and without going through a molding step, allowing to significantly shorten the lead times and to reduce production costs. The process according to the invention thus allows considering new, faster parts developments.

The present invention is not restricted to the example of embodiment described, but extends to any modification and variant which is obvious to a person skilled in the art, in particular, the figures are only examples gained from the tests carried out to date to validate the process. They have no limiting effect on the scope of the invention.

The invention claimed is:

1. A process for producing a ceramic casting core (20) for the manufacture of a hollow part with a complex cavity by lost-wax casting, and the core (20) being an image of the complex cavity of the hollow part to be produced, the method comprising:

manufacturing the core (20) by machining a fired ceramic material block (1) with the machining being performed by mechanical removal of material via a cutting tool, and the machining comprises at least a first machining step to realize a first machined surface (6, 7) in the material block (1) and a second machining step to realize a second machined surface (9) in the material block (1), substantially opposite to the first machined surface (6, 7), prior to the second machining step, applying a reinforcement layer (8, 11), made of a stiffening solution to protect the material block (1) from breaking during the second machining step, on at least part of the first machined surface (6, 7), and waiting for solidification of the reinforcement layer (8, 11) before carrying out the second machining step, and after the machining of the core (20), removing the reinforcement layer(s) (8, 11).

2. The production process according to claim 1, further comprising using several machining steps during machining and repeating application of the reinforcement layer (8, 11) before every new machining step on at least part of a surface of the material block (1) substantially opposite to the new surface to be machined.

3. The production process according to claim 1, further comprising cleaning and degreasing the material block (1), prior to the application of the reinforcement layer (8, 11), to improve adhesion of the stiffening solution thereto.

4. The production process according to claim 1, further comprising using a liquid or a semi-liquid machining glue having machinable and dissolvable properties as the stiffening solution.

5. The production process according to claim 4, further comprising applying the reinforcement layer (8, 11) during one or more applications of the stiffening solution.

6. The production process according to claim 4, further comprising applying the stiffening solution on the material block (1) with a brush.

7. The production process according to claim 4, further comprising applying the stiffening solution on the material block (1) by pouring and gravity.

8. The production process according to claim 1, further comprising using a numerically controlled multi-axis machining center to machine the core (20) in the material block (1).

9. The production process according to claim 1, further comprising using diamond cutting tools for machining the core (20) in the material block (1).

10. The production process according to claim 1, further comprising, to machine the core (20) in the material block (1), using a material block (1) comprising at least two parallel opposite sides arranged to form two clamping faces (4) on which jaws (2) of a clamping vise (3) of a machining equipment are applied.

11. The production process according to claim 1, further comprising, prior to the machining of the core (20), machining at least one reference surface (5) in the material block (1) that will allow removing and putting the material block (1) back in place on a machining equipment while respecting parallelism deviation lower than 0.00196 inches (0.05 mm).

12. The production process according to claim 1, further comprising dipping the core (20) in a solvent bath in order to remove the reinforcement layer(s) (8, 11).

13. The production process according to claim 1, further comprising, to remove the reinforcement layer(s) (8, 11), subjecting the core (20) to a temperature rise up to at least a melting temperature of the stiffening solution.

14. The production process according to claim 13, further comprising suspending the core (20) on a bracket to allow draining of the stiffening solution by gravity.

15. The production process according to claim 13, further comprising producing one of a rotor, a stator for a gas turbine, an aircraft engine, a reactor, a combustion chamber or the like as the hollow part with the complex cavity.

* * * * *